United States Patent [19]

Hudson et al.

[11] 3,994,252

[45] Nov. 30, 1976

[54] METHOD FOR THE PRODUCTION OF BLACK PLATE WITH IMPROVED SURFACE LUBRICITY

[75] Inventors: Robert M. Hudson, Churchill; Clair J. Warning, Plum Boroughs, both of Pa.

[73] Assignee: United States Steel Corporation, Pittsburgh, Pa.

[22] Filed: Dec. 22, 1975

[21] Appl. No.: 643,461

[52] U.S. Cl. ..... 113/120 A; 72/42; 252/49.3

[51] Int. Cl.[2] ..... B21D 51/10; B21B 45/02

[58] Field of Search ..... 113/120 A; 72/42, 46; 252/46.4, 49.3; 220/64

[56] References Cited

UNITED STATES PATENTS

| | | | |
|---|---|---|---|
| 2,182,304 | 12/1939 | Rolle | 113/120 A |
| 2,231,228 | 3/1941 | Singer | 72/42 X |
| 2,406,039 | 8/1946 | Roedel | 113/120 A |
| 3,125,519 | 3/1964 | Grave et al. | 72/42 |
| 3,215,630 | 11/1965 | Compton et al. | 252/49.3 X |
| 3,360,157 | 12/1967 | Bolt et al. | 113/120 A X |
| 3,577,753 | 5/1971 | Shah | 113/120 A |

*Primary Examiner*—Leon Gilden
*Attorney, Agent, or Firm*—Arthur J. Greif

[57] ABSTRACT

To prevent galling during the drawing and ironing process, black plate is provided with an economical coating for improving surface lubricity. Cold-reduced strip is rinsed with a solution containing soluble salts of manganese and sulfur, e.g. $MnSO_4$; the strip is dried and then heated to above 800° F in a reducing atmosphere, such as HNX. Heating is conducted at a temperature sufficient to reduce the sulfates and provide a surface coating of MnS in which the surface sulfur concentration is in excess of 0.5%.

7 Claims, No Drawings

METHOD FOR THE PRODUCTION OF BLACK PLATE WITH IMPROVED SURFACE LUBRICITY

This invention relates to the manufacture of ferrous metal strand stock (sheet or strip) with improved surface lubricity and is particularly related to the production of black plate which is suitable for the use in drawing and ironing processes.

A number of processes are now being employed for the fabrication of containers e.g. food containers or cans, from steel strip. Of these, the drawing and ironing process for the production of seamless container bodies is gaining significant importance. Basically, this process first involves drawing the steel blank into a shallow cup by forcing the blank through one or more drawing dies. Subsequently, the drawn cup is passed through one or more ironing dies, the inside diameters of which are progressively smaller, resulting in the thinning and elongation of the side walls of the cup. A fuller discussion of this process is provided in, for example, U.S. Pat. No. 3,670,543. As shown therein, this process has been successfully employed in the manufacture of containers from steel strip which is coated with a softer metal, e.g. tin plate, which has self-lubricating properties. Obviously, if black plate could be employed in the drawing and ironing process, a substantial saving would be offered to the can maker, as compared with the use of tin plate. However, since the ironing step subjects the blank to extreme mechanical deformation and friction, both galling of the ironing die and fracture of the blank have generally been encountered when using black plate. Special lubrication practices have been developed for the use of black plate. However, these practices have either been not totally satisfactory in the elimination of galling or have been excessively costly so as to seriously detract from the economic advantages of black plate. For example, one prior practice consisted of using oiled black plate for the first draw, oiling before the redraw and thereafter applying phosphate coatings to the redraw cup before ironing. In order to lower canmaking costs, the redraw operation has now been substantially eliminated. However, the single draw appears to be a more severe fabrication, requiring better lubrication than the draw-redraw sequence. Thus, in addition to eliminating galling problems occurring in the ironing step, there is a need for improved lubricity in the drawing steps as well. The application of special lubricants to the drawing step, which previously had only been necessary for the ironing stages has significantly added to the cost of using black plate. It would therefore be desirable if the lubricity of the black plate surface could be improved by the application of an inexpensive coating thereon, which coating would be beneficial both for the drawing and ironing stages.

Because the method employed to improve lubricity must be economical from the standpoint of both the steel producer and the can maker, coating methods that could be used "in-line" with existing processing units will generally offer greater economical benefits. The instant process, which involves a pre-anneal rinse in $MnSO_4$ solutions, is amenable to such "in-line" production. Work leading to the instant invention was based on the concept of producing a coating on the steel surface, which coating would be softer than the steel surface itself, somewhat analogous to that of using softer electrocoated tin. Since metal sulfides, in general, are known to have Moh hardness ratings below that of annealed low carbon steel, the use of corresponding metal sulfates was considered for application in a pre-anneal rinse for the production of metal sulfide coatings, utilizing a procedure somewhat analogous to that shown in our U.S. Pat. No. 3,707,408. In the evaluation of potentially promising rinses, bench scale tests were made on panels of Type D steel using dried-on aqueous solutions of a number of metal sulfates, and a number of other salts, as well. The specimens were dipped into the respective solution, dried and then heated for four hours at 1250° F in a 95% $N_2$ — 5% $H_2$ atmosphere having a dew point below −40° F. Screening of these samples was initially conducted utilizing a friction test, in which samples were clamped together with a clamping force of 300 psi and thereafter pulled apart longitudinally to (i) quantitatively measure the pulling force required and (ii) visually derive an indication of die scoring. It should be borne in mind that the tendency to scoring or galling in this test is less severe than the tendency to galling resulting during the ironing operation in the production of seamless containers. Therefore, it may readily be concluded that any lubricant system which exhibited galling tendencies in the friction test would always rate poor under actual drawing and ironing procedures. The results of this screening test are presented in Table I below.

TABLE I

SCREENING EVALUATION-FRICTION TEST RESULTS

| Treatment* | Pulling Force,** lb | Galling (Die Scoring) |
|---|---|---|
| None | Broke | Severe |
| 0.1 M $MnSO_4$ | 580 | Trace |
| 0.2 M $MnSO_4$ | 425 | None |
| 0.1 M $Al_2(SO_4)_3$ | 640 | Light |
| 0.2 M $Al_2(SO_4)_3$ | 600 | None |
| 0.2 M $ZnSO_4$ | 520 | None |
| 0.2 M $CuSO_4$ | 460 | None |
| 0.1 M LiOOCH | 680 | None |
| 0.1 M $Mg(OOCH)_2$ | 770 | Medium |
| 0.1 M $SnSO_4$ | 800 | Medium |
| 0.2 M $SnSO_4$ | 580 | Medium |
| 0.1 M $FeSO_4$ | 790 | Medium |
| 0.1 M $NiSO_4$ | Broke | Light |
| 0.1 M $CoSO_4$ | Broke | Heavy |
| 0.2 M $[(NH_4)_2 MoO_4]$ | Broke | Medium |
| 0.1 M $MgSO_4$ | Broke | Light |
| 0.1 M $Al(OOCH)_3$ | Broke | Severe |
| 0.2 M $Pb(C_2H_3O_2)_2$ | 820 | Severe |

*All metal sulfate and ammonium molybdate solutions listed in this table also contained 0.1 M $H_2SO_4$.

**Clamping force for all these tests was 300 psi (2068 kN/m²).

It may be noted above that untreated black plate specimens gall badly and break during the friction test. However, certain pre-rinses did appear to materially reduce friction and/or eliminate galling. Therefore, those rinses which both (i) exhibited a pulling force of less than about 600 lbs. and (ii) eliminated galling, were further evaluated in a laboratory D and I press. It may be seen by reference to Table II below, that untreated black plate exhibited galling and scoring on the laboratory press (utilizing tungsten-carbide dies and DIEGARD lubricants) by the second or third can and thereafter became progressively worse. Similarly, most of the other treatments that appeared promising in the less severe friction test exhibited galling by, at most, the sixth can. By contrast, the $MnSO_4$ treatment permitted the production of 24 cans with no galling or scoring.

TABLE II

GALLING EVALUATION-LABORATORY D & I PRESS

| Treatment | Galling |
|---|---|
| 0.2M $ZnSO_4$<br>0.1M $H_2SO_4$ | 4th piece-galled |
| 0.2M $CuSO_4$<br>0.1M $H_2SO_4$ | 6th piece-heavy scratches |
| 31 g/l $Mg(HCO_2)_2$ | 2nd piece-galled |
| 0.2M $Al_2(SO_4)_3$<br>0.1M $H_2SO_4$ | 1st piece-Clipped-off |
| 0.2M $MnSO_4$<br>0.1M $H_2SO_4$ | 24* |

*Testing ended after 24 samples-as indicative of successful operation.

In addition to materially reducing the tendency to galling, the $MnSO_4$ treatment evidenced load forces approaching those of 0.25 lbs/bb tin plate, and the appearance of the cans was excellent. In a further evaluation utilizing a commercial D & I press, the coating of this invention prevented die pick-up, even when a press jamb causing heavily wrinkled cups occurred. With untreated black plate, heavily wrinkled cups will almost always result in die pick-up. In some instances, when utilizing the commercial D & I press slight amounts of galling were encountered during the ironing operation. In those cases, analysis of the cups' surfaces showed that substantially all the MnS was removed from the sides of the cups during drawing. Nevertheless, in view of the significant reduction in galling which was achieved and the economic advantages of this treatment, the process was employed to treat four full size (each about 9,500 lbs.) electrolytically, alkaline-cleaned coils of Type D steel. These coils, with dried-on solutions of 0.2 M $MnSO_4$ were box annealed in a $T_1$ cycle. Two of the coils were annealed in an HNX atmosphere while the other two were annealed utilizing a DX gas. Annealed coils were thereafter temper rolled to a No. 5 finish. Samples of the material so produced, were thereafter evaluated in both the friction test and in the D & I press. Although friction test results were good, these commercially-treated samples did not exhibit the anti-galling performance (during cupping operations) which was achieved for the laboratory-treated samples. Further evaluation which compared the surface characteristics of both the acceptable (laboratory treated) and non-acceptable (commercially treated) product showed that the major surface constituent of the former was $\alpha$-MnS (alabandite). It was additionally determined that while both treatments achieved a surface enrichment of Mn, the samples from the acceptable group exhibited significantly higher concentrations of sulfur. It was found that the differences in sulfur concentration were primarily affected by the nature of the annealing atmosphere (Table III). Two factors are of prime importance here: (i) the annealing atmosphere should be non-oxidizing to iron, because the formation of surface oxides will interfere with the reduction of $MnSO_4$ to MnS and (ii) the dew point of the atmosphere can materially decrease the amount of surface enrichment of sulfur. Thus, as seen in Table III, atmospheres with a dew point significantly above −25° F resulted in surfaces with only a minor amount of sulfur enrichment. It was this latter factor which resulted in the poor performance of the above noted commercially-treated coils; since dew points well in excess of −25° F are commonly encountered in commercial box annealing, unless special care is taken initially to dry-out the base and thereafter to assure ar ample flow of dry make-up gas throughout the cycle.

TABLE III

AFFECT OF ANNEALING ATMOSPHERE (6% $H_2$ - 94% $N_2$) DEW POINT ON SURFACE COMPOSITION

| Sample No. | Dew Point, F | Time Held at 1250 F, hr | Surface Composition (X-ray analysis), percent | |
|---|---|---|---|---|
| | | | Mn | S |
| 1 | −46 | 8 | 0.63 | 2.04 |
| 2 | " | 16 | 0.66 | 1.65 |
| 3 | " | 24 | 0.70 | 1.79 |
| 6 | −25 | 8 | 0.65 | 0.52 |
| 8 | −15 | 8 | 0.64 | 0.11 |
| 9 | +20 | 8 | 0.60 | 0.10 |

The procedure of this invention may therefore be carried out in the following preferred manner. Black plate is produced in a conventional manner, that is, the hot-rolled strip is pickled, oiled and cold reduced to the desired final gauge. The cold rolling lubricants are thereafter removed, e.g. by an alkaline treatment to produce a thoroughly clean surface so as to assure the application of a continuous film of $MnSO_4$. A film of $MnSO_4$ is thereafter applied to the thoroughly-cleaned surface, i.e. by dipping or spraying a solution having a concentration of 0,05 to 2.OM $MnSO_4$, preferably 0.1 to 0.5M $MnSO_4$, and metered to provide a film thickness which on subsequent drying will yield a coating of from 10 to 50 mg of Mn per sq. ft. of surface, preferably 15 to 35 mg/ft$^2$ of Mn. The so-metered film is thereafter dried at a temperature of less than 300° F, so as to remove substantially all the physically bound water. Drying temperatures should be low enough to prevent surface oxidation. The black plate, having the dried coating thereon, is thereafter annealed to the desired temper, generally a $T_1$ temper, i.e. soft enough for subsequent forming. Annealing may be conducted, for example, by box annealing, in an atmosphere having a dew point below about −25° F so as to provide a surface sulfur concentration in excess of 0.5%. Atmospheres with a dew point below −35° F are preferred, so as to achieve a more desirable surface sulfur concentration of about 1 to 2%. It should be noted that the cited surface concentrations (for Mn and S) represent the average concentration of these elements in a layer that extends from the outer surface of the steel to a depth of about 0.002 inch as determined by X-ray analysis. Thus the concentrations of Mn and S in a thin surface film that is substantially MnS (stoichiometrically 63.1% Mn and 36.9% S) is averaged with the corresponding concentrations of these elements in the underlying steel (typically 0.4% Mn and 0.02% S) to derive the reported values. A reported value of 1 percent S, therefore, indicates that this is the average concentration of sulfur in a layer of 0.002 inch thickness. The so-annealed strip or sheet may thereafter, optionally, be temper rolled to improve shape. If the black plate is to be employed for the production of containers by a D & I procedure, the strip may either be utilized using the more conventional D & I procedures or it may initially be drawn and thereafter be provided with a further lubricant, e.g. a phosphate treatment, prior to the ironing of the cup so as to further diminish the tendency to galling.

While the invention has primarily been described in its application to the drawing and ironing of steel strip, it will readily be apparent that ferrous metal strand stock may be coated by the process of this invention to provide surface lubricity for a variety of analogous forming operations.

We claim:

1. In the cold working of low carbon ferrous metal strand stock, wherein prior to said cold working the surface of said stock is provided with a lubricant coating system, the improvement wherein at least one of the lubricants in said system is a coating which is provided by, a. cleaning said surface, b. applying an aqueous solution consisting essentially of from 0.05 to 2.0 M $MnSO_4$ to said cleaned surface, to provide an aqueous film thereon, c. metering said aqueous film to an extent which will provide a dried coating weight of from 10 to 50 mg of Mn per sq. ft. of surface, d. drying said aqueous film to remove substantially all the physically bound water therefrom and e. heating said stock to a temperature of from about 800°–1650° F in a reducing atmosphere to reduce said sulfate and provide a surface concentration of sulfur thereon, in excess of about 0.5%.

2. The method of claim 1, wherein the concentration of solution is from 0.1 to 0.5 M $MnSO_4$ and said aqueous film is metered to provide a dried coating weight of 15 to 35 mg/ft$^2$ of Mn.

3. The method of claim 1, wherein said heating is conducted under conditions sufficient to provide a surface sulfur concentration of about 1 to 2%.

4. In the process for the production of low carbon ferrous metal strip stock, wherein said stock is employed in the production of seamless containers by the drawing and ironing thereof, said process including the step of annealing cold-reduced strip at a temperature of about 1000° to 1500° F to relieve the stresses therein, the improvement in which a lubricant coating is provided on at least one surface of said stock, comprising prior to said annealing, a. to a cleaned surface of said sheet, applying an aqueous solution consisting essentially of from 0.05 to 2.0 M $MnSO_4$ to provide a film of said solution on said surface, b. metering said film to a thickness which will result in a coating weight of from 10 to 50 mg/ft$^2$ of Mn when dried, c. drying said film, and d. conducting said annealing under reducing conditions sufficient to provide, on the treated surface of said stock, a surface concentration of sulfur of greater than 0.5%.

5. The method of claim 4, wherein said stock is box annealed in a reducing atmosphere having a dew point below −25° F.

6. The method of claim 4, wherein the concentration of said solution is from 0.1 to 0.5 M $MnSO_4$ and said aqueous film is metered to provide a dried coating weight of 15 to 35 mg/ft$^2$ of Mn.

7. The method of claim 6, wherein said annealing is conducted so as to provide a coating containing $\alpha$MnS.

* * * * *